United States Patent [19]

Meyers

[11] Patent Number: 4,753,299

[45] Date of Patent: Jun. 28, 1988

[54] GRADER BLADE ASSEMBLY AND PICK THEREFOR

[76] Inventor: Thomas A. Meyers, 142 Field St., Mackay, Australia, 4740

[21] Appl. No.: 859,136

[22] Filed: May 2, 1986

[51] Int. Cl.[4] ..... E02F 9/28; E02F 3/815; E21C 35/18

[52] U.S. Cl. ..... 172/777; 37/266; 37/141 R; 172/747; 172/701.3

[58] Field of Search ..... 172/701.1, 701.2, 701.3, 172/777, 766, 747; 37/142 R, 141 T, 142, 141 R, 266

[56] References Cited

U.S. PATENT DOCUMENTS

| | | | |
|---|---|---|---|
| 1,540,314 | 6/1925 | Clark | 37/141 T |
| 1,633,057 | 6/1927 | Wold | 172/701.3 |
| 1,922,917 | 8/1933 | Russel | 37/266 |
| 2,092,311 | 9/1937 | Hosmer | 172/777 |
| 2,892,270 | 6/1959 | Sharp | 172/777 |
| 3,192,653 | 7/1965 | Socin | 172/701.3 |
| 3,312,504 | 4/1967 | Makinen | 172/777 X |
| 3519309 | 7/1970 | Engle et al. . | |
| 3,520,076 | 7/1970 | Nichols | 172/777 |
| 3,882,594 | 5/1975 | Jackson | 172/747 |
| 3,934,654 | 1/1976 | Stephenson | 172/747 |
| 4,108,250 | 8/1978 | Merkel | 172/777 |
| 4,595,241 | 6/1986 | Gilbert | 37/142 R |
| 4,611,417 | 9/1986 | Carlson | 37/141 T |

FOREIGN PATENT DOCUMENTS

| | | | |
|---|---|---|---|
| 146117 | 5/1951 | Australia . | |
| 151678 | 9/1952 | Australia . | |
| 165834 | 2/1954 | Australia . | |
| 465027 | 2/1973 | Australia . | |
| 29883 | 4/1979 | Australia . | |
| 54924 | 8/1980 | Australia . | |
| 140523 | 5/1953 | Sweden | 172/777 |
| 306308 | 6/1955 | Switzerland | 172/701.1 |
| 1527588 | 11/1978 | United Kingdom . | |

*Primary Examiner*—Richard J. Johnson
*Attorney, Agent, or Firm*—Kenyon & Kenyon

[57] ABSTRACT

A blade assembly for hard earth road graders has a support frame for attachment to the mouldboard of the road grader and a plurality of evenly spaced picks located in sockets spaced along the lower edge of the support frame. The picks have spigots to releasably locate in the support frame sockets and engage with the support frame to prevent relative rotation between the spigots of the picks and respective sockets. The picks each have a tungsten carbide tile attached to their front face with a straight transverse cutting edge along the lower edge. In use the working face of the picks is perpendicular to a road surface to achieve a shaving action.

11 Claims, 2 Drawing Sheets

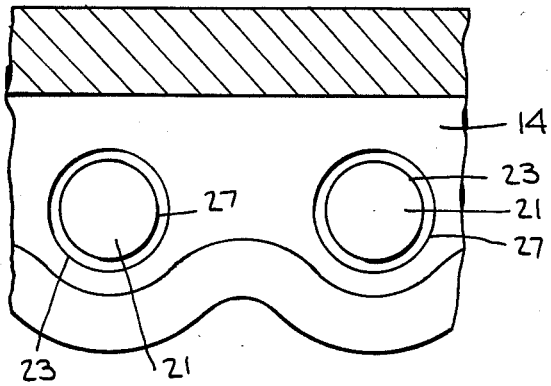
Fig. 3.
Fig. 4.
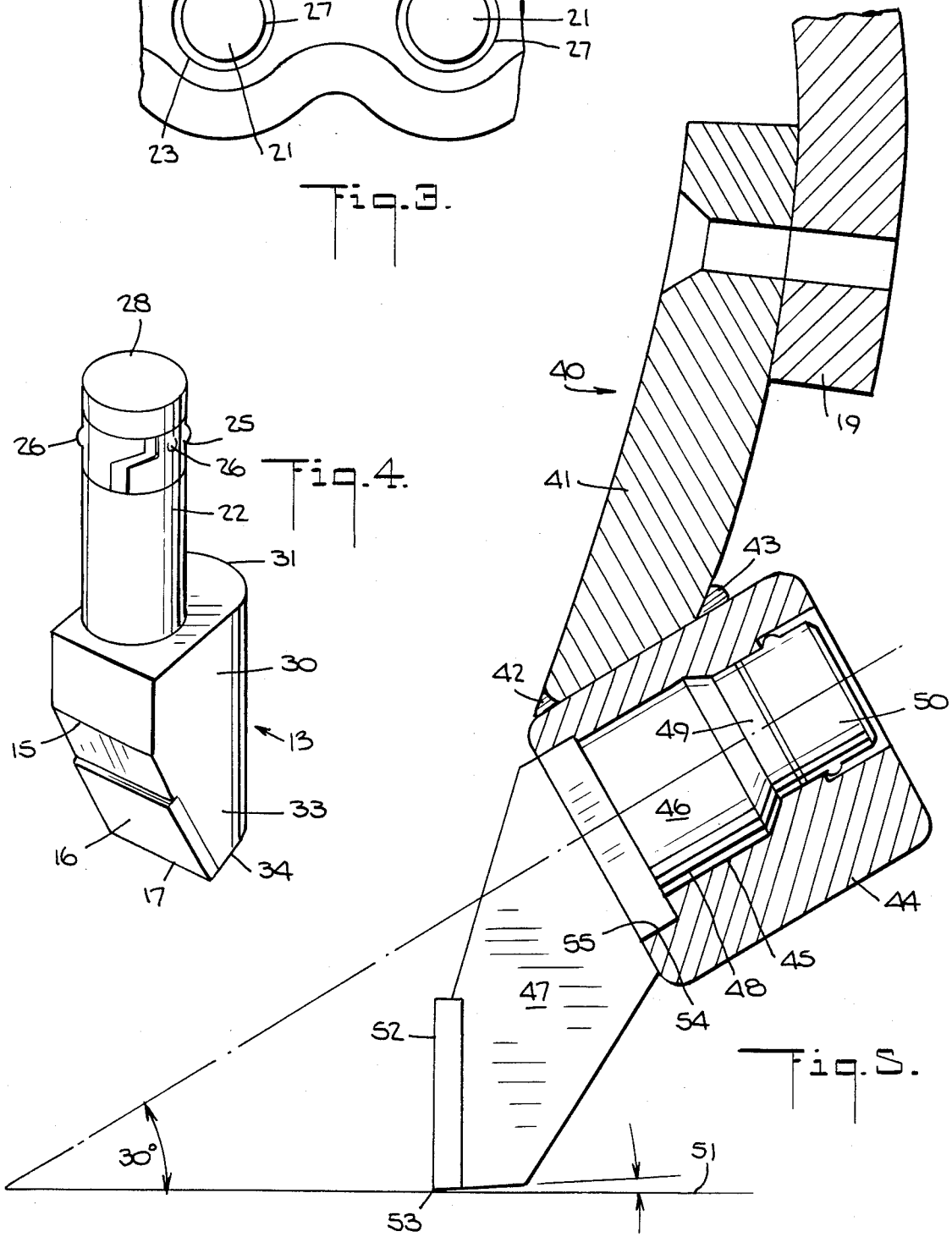
Fig. 5.

GRADER BLADE ASSEMBLY AND PICK THEREFOR

BACKGROUND OF THE INVENTION

This invention relates to improvements in earth working apparatus and in particular to earth graders of the type comprising an angularly adjustable transverse mouldboard having affixed thereto a cutting blade.

Earth graders have hitherto comprised a mouldboard having a single replaceable cutting edge bolted along the lower edge of the mouldboard or for ease of handling a plurality of replaceable cutting edges bolted in end to end relationship along the lower edge of the mouldboard. While such earth graders are generally satisfactory for grading of soft earth formations they are quite unsatisfactory for dressing of hard earth formations such as highly compacted unsealed motorways or haulways in a mine environment.

With conventional grader blades, the continuous cutting edge prevents the blade from penetrating the upper compacted layer of the road surface and the blade tends to skid ineffectually along the road surface.

It has been proposed to utilize a grader blade having a serrated cutting edge comprising a plurality of broad cutting teeth approximately four inches wide separated by gaps of approximately one inch wide. On a grader blade measuring say eighteen feet in width, the serrated cutting edge may be formed from either three or four sections bolted to the lower edge of the mouldboard. Each cutting edge section is fabricated from a single piece of steel approximately one inch thick. The teeth formed on the lower edge are tapered rearwardly from a sharp transverse cutting edge to the full thickness of the section towards the root of the teeth.

While such serrated grader blades are substantially better than continuous edge blades on hard road surfaces, they nevertheless suffer significant disadvantages. Due to the necessary downward pressure required to shave a highly compacted road surface, the sharp edges of the teeth have a tendency to suddenly penetrate the road crust at irregular intervals causing deep transverse excavations into the less compacted earth below. Apart from destroying the integrity of the road crust, the sudden penetration can cause the grader to stall.

Possibly the most significant disadvantage of such prior art serrated blades is the predisposition to breakage of the teeth which necessitates costly and time consuming stoppages while sections of cutting edge are replaced.

Australian Pat. No. 518204 (based on U.S. patent application Ser. No. 8,435 filed Feb. 1, 1979) proposes a road planing apparatus incorporating a rotary drum having mounted thereon generally tangentially oriented bits or picks which strike and dig into the roadway surface as the drum rotates. The bits or picks comprise hardened pointed tip mounted on a body having a shank portion releasably located in blocks on the drum.

Similar point attack bits or picks or picks originally developed for coal mining are described in U.S. Pat. No. 3,519,309 and in British Patent Application No. 29900/77 relating to point attack bits for tunnelling machines. Point attack bits are very effective in rotary excavation apparatus due to their gouging action through a changing angle of attack. Point attack bits find their greatest use in material that fractures when penetrated.

It has been found that the use of sharpened or pointed cutting edges such as those employed in rotary excavators causes the brittle compacted road surface to fracture enabling the pointed cutting edges to deeply penetrate the earth surface causing dislodgement of large sections of road surface. Dressing of road surfaces using pointed cutting edges results in a layer of loose material being left on the road surface which must then be removed by a conventional road grader in a separate process. The remaining loose uncompacted road surface quickly develops surface irregularities such as pot holes, ruts, corrugations and the like due to heavy traffic.

It is important therefore in the maintenance of compacted earthen roadways to be able to smooth out surface irregularities and at the same time maintain the integrity of a highly compacted road surface. There is a need therefore to provide a greater blade assembly which in use is effective to shave the compacted road surface to remove irregularities therefrom without causing the compacted road surface to become fractured and at the same time remove the material shaved from the road surface.

SUMMARY OF THE INVENTION

The present invention aims to overcome or at least alleviate the disadvantages of prior art grader blade assemblies for dressing of hard road surfaces and to provide a grader blade assembly which substantially reduced downtime associated with worn, damaged or broken cutting edges and which alleviates the need to replace the entire cutting edge assembly in the event of damage to one or more cutting teeth.

The replaceable pick of the present invention is provided with a hardened cutting edge and working face to provide an efficient cutting action on compacted earthen roadways and may be easily replaced in the event of wear or damage so that operational downtime is reduced.

According to the invention there is provided a blade assembly for attachment to the mouldboard of an earth grader, said blade assembly comprising:

an elongate body member attachable along the lower edge of a grader mouldboard, said body member including along its lower rear edge a plurality of spaced sockets for releasably locating cutting picks in spaced relationship;

and a plurality of removable cutting picks each located in a respective socket to form a discontinuous cutting edge along a lower edge of said blade assembly, each said cutting pick having a transverse straight cutting edge along the lower edge of a working face of each said cutting pick.

According to the invention there is also provided a cutting pick for hard road graders, said pick comprising:

a body portion having an upper surface, a substantially planar leading surface, opposed side surfaces and a trailing surface opposing said leading surface and a tip surface at an end remote from said upper surface, said leading surface including a hardened metal alloy working face attached thereto, said working face having a transverse straight cutting edge adjacent said tip;

a supporting shank including retention means for releasably retaining said supporting shank in a locating socket of a grader blade assembly, said body portion including at least one shouldered abutment associated with said upper surface for engagement with a corresponding abutment on said grader blade assembly to prevent relative rotation between said cutting pick and said grader blade assembly.

BRIEF DESCRIPTION OF THE DRAWING

In order that the invention may be more readily understood and put into practical effect, reference is made to the accompanying drawings which illustrate various preferred embodiments of the invention.

FIG. 3 is a view in the direction A—A of FIG. 2;

FIG. 4 is an isometric view of a replaceable cutter pick;

FIG. 5 is a cross-sectional view of an alternative embodiment of the assembly shown in FIG. 2.

DETAILED DESCRIPTION

Figure 1:
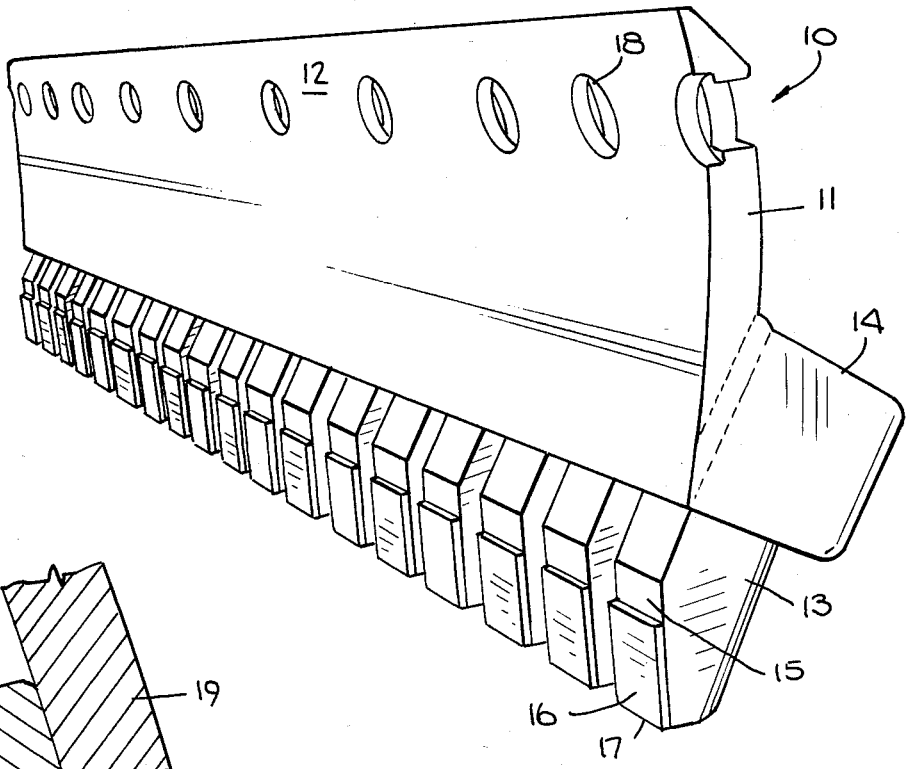
FIG. 1 is a front elevation of a grader blade assembly.

Referring to the drawings there is illustrated in FIG. 1 a grader blade assembly 10 comprising a body 11 having an arcuate upper portion 12 for attachment to a corresponding arcuate face of a conventional grader mouldboard (not shown). The body 11 may be formed suitably from cast iron or it may be fabricated from welded and machined components.

Depending downwardly from body 11 are a plurality of cutting picks 13 mounted in spaced relationship along a lower edge of said body by means of a socket and spigot connection in a lower body portion 14.

The cutting picks 13 have a generally upright leading face 15 attached to which are hardened metal alloy working faces 16 comprised of tungsten carbide or the like. The lower edges of the picks 13 have a straight cutting edge 17. A plurality of spaced apertures 18 are provided for mounting a blade assembly 10 to a grader mouldboard.

Figure 2:
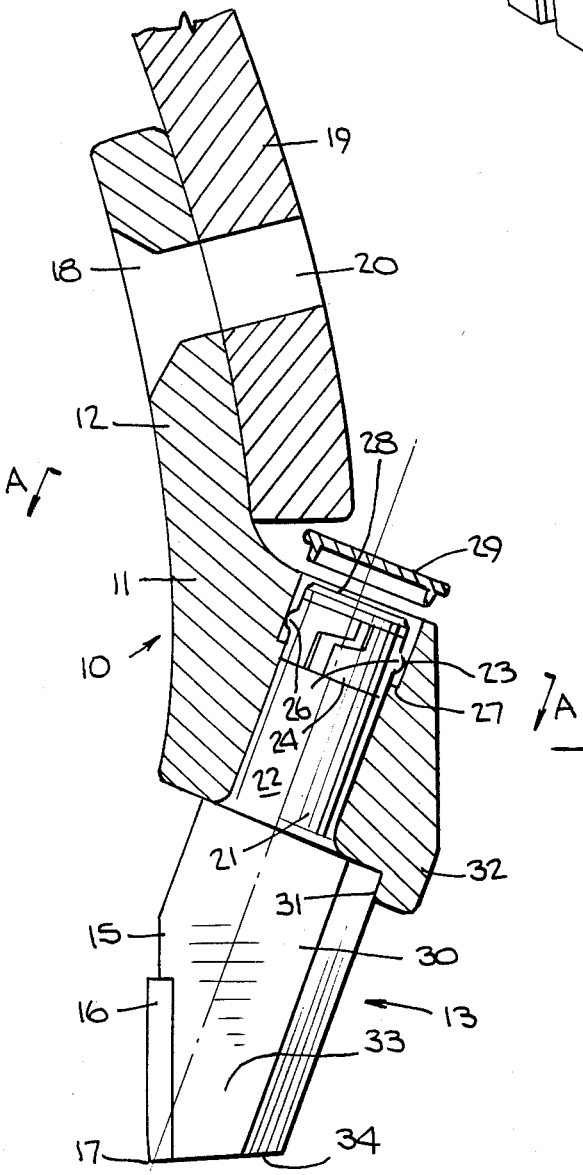
FIG. 2 is a cross-sectional view of the assembly of FIG. 1 shown fitted to a grader mouldboard.

FIG. 2 shows a cross-sectional view of the arrangement of FIG. 1 attached to a mouldboard of a grader.

Arcuate upper portion 12 is mounted on a corresponding arcuate lower portion of a mouldboard 19 by means of a bolt (not shown) extending through apertures 18 in blade assembly 10 and aligned apertures 20 in mouldboard 19.

The lower portion 14 of body 11 includes a socket 21 which receives a mounting spigot 22 of pick 13. The upper end 23 of socket 21 is of enlarged diameter to receivably locate a resilient locating clip 24 having dimpled outwardly extending projections 26 which engage against the shouldered projection 27 at the junction of the normal and enlarged socket diameters. The resilient clip 24 retains the pick in its socket during normal working conditions however it enables the pick to be readily removed by striking its upper end 28 with a hammer and suitable drift. A removable resilient plastics cap 29 seals the upper end of the socket against ingress of dirt and moisture.

At the region on the junction between spigot 22 and the pick body 30 is a shouldered abutment 31 which engages with a corresponding shouldered abutment 32 in lower body portion 14. This prevents, in use, relative rotation between the pick 13 and the body 11 of the blade assembly 10.

The substantially planar front face 15 of pick body 30 is angled rearwardly to provide a substantially upright leading face with the mouldboard 19 in its normal working position.

The tip 33 of pick 13 has a rearwardly extending face 34 angled at about 85 degrees relative to the front face of the tungsten carbide working face 16. In use this rearwardly extending face 34 acts as a heel to assist in preventing penetration of the brittle hard earth surface by the pick 13.

The blade assembly 40 comprises an upper body portion 41 formed of rolled steel plate welded at its front and rear lower edges 42,43 respectively to a length of machined steel bar 44.

Bar 44 includes a plurality of spaced sockets 45 to receive the mounting spigots 46 of picks 47. Spigots 46 include an enlarged diameter lower shank portion 48 to resist breakage and an upper shank portion 49 of lesser diameter to accommodate the retaining clips 50.

The normal working axial inclination of socket bores 45 is of the order of about 30 degrees relative to a ground surface 51 compared with about 60 degrees for the embodiment of FIG. 2 and the inclination of working face 52 relative to the bore axis is about 60 degrees compared with about 30 degrees for that of FIG. 2.

By displacing the cutting edge 53 of pick 47 away from the axis of the mounting spigot 46 and decreasing the angle of the mounting spigot axis relative to a ground surface, resultant forces on the pick during use give rise to less rotational forces being applied about the rotational axis of the pick spigot and thus less wear between the spigot and socket.

Wear due to rotational forces is even further reduced by providing rectangular walled recessed socket 54 in bar 44 to receive a complementary rectangular walled spigot portion 55 on the lower end of spigot 45.

What is claimed is:

1. A blade assembly for attachment to the mouldboard of an earth grader, said blade assembly comprising:

an elongate body member attachable along the lower edge of a grader mouldboard, said body member including along its lower edge a plurality of spaced sockets for releasably locating cutting picks in spaced relationship; and a plurality of removable cutting picks each locatable in a respective socket to form a discontinuous cutting edge along a lower edge of said blade assembly, each said cutting pick having:

a body portion with an upper surface, a substantially planar leading surface, opposed side surfaces and a trailing surface opposing said leading surface and a tip surface at an end remote from said upper surface, said leading surface including a hardened metal alloy working face having a transverse straight cutting edge adjacent said tip; and a supporting shank including retention means for releasably retaining said supporting shank in a respective one of said sockets of the elongate body member, said body portion including at least one shouldered abutment associated with said upper surface for engagement with an corresponding abutment on said body member to prevent relative rotation between said cutting pick and said body member, said supporting shank having an axis inclined at an angle of from about 45 degrees to about 80 degrees rearwardly relative to said working face.

2. A blade assembly as claimed in claim 1 wherein said angle is approximately 60 degrees.

3. A blade assembly as claimed in claim 2 wherein the axes of respective locating sockets for said cutting picks are inclined at an angle of about 60 degrees relative to the ground surface when said grader moldboard is in a normal working position, whereby the working face of each said cutting pick is substantially perpendicular to the ground surface when said grader moldboard is in a normal working position.

4. A blade assembly as claimed in claim 1 wherein said picks are spaced at equidistant intervals along the lower edge of said body member, the spacing between picks being about the same as the transverse width of said picks.

5. A blade assembly as claimed in claim 1 wherein said retention means comprises a resilient locating clip.

6. A blade assembly as claimed in claim 5 wherein said locating clip is provided with dimpled outwardly extending projections.

7. A blade assembly as claimed in claim 1, further comprising a plurality of resilient plastic sealing caps each removably attached to said elongate body member at an upper end of a respective one of said sockets.

8. A cutting pick blade assembly attachable to a moldboard of an earth grader, said blade assembly including an elongate body member attachable along the lower edge of the grader moldboard, said body member being provided along its lower edge with a plurality of spaced locating sockets, each said cutting pick comprising:

a body portion having an upper surface, a substantially planar upright leading surface, opposed generally parallel side surfaces and a trailing surface opposing said leading surface and a generally flat tip heel surface at an end remote from said upper surface, said leading surface including a hardened metal alloy working face having a transverse straight cutting edge adjacent said tip; and a supporting shank including retention means releasably retaining said supporting shank in a respective one of the locating sockets of the grader blade assembly, said body portion including at least one shouldered abutment associated with said upper surface in engagement with a corresponding abutment on said grader blade assembly to prevent relative rotation between said cutting pick and said grader blade assembly, said supporting shank having an axis included at an angle of from about 30 degrees to about 60 degrees relative to a horizontal ground surface.

9. A cutting pick blade assembly as claimed in claim 8 wherein said angle is about 60 degrees.

10. A cutting pick blade assembly as claimed in claim 8 wherein said working face comprises a rectangular plate or hardened tungsten carbide metal alloy attached to said leading surface.

11. A cutting pick blade assembly as claimed in claim 8 wherein said tip surface is a substantially planar surface inclined at about 85 degrees to said working face.

* * * * *